US009016392B2

(12) United States Patent
Khalil et al.

(10) Patent No.: US 9,016,392 B2
(45) Date of Patent: Apr. 28, 2015

(54) FIRE SUPPRESSION SYSTEM WITH IMPROVED TWO-PHASE FLOW DISTRIBUTION

(75) Inventors: Yehia F. Khalil, Glastonbury, CT (US); Muhidin A. Lelic, Londonderry, NH (US); Giuliano Amantini, Glastonbury, CT (US); Ravi K. Madabhushi, Longmeadow, MA (US); Marios C. Soteriou, Middletown, CT (US); May L. Corn, Manchester, CT (US); Robert G. Dunster, Slough (GB); Rob J. Lade, Marlow (GB)

(73) Assignee: UTC Fire & Security Corporation, Farmington, CT (US)

( * ) Notice: Subject to any disclaimer, the term of this patent is extended or adjusted under 35 U.S.C. 154(b) by 1234 days.

(21) Appl. No.: 12/936,831

(22) PCT Filed: Apr. 10, 2008

(86) PCT No.: PCT/US2008/059815

§ 371 (c)(1),
(2), (4) Date: Jan. 27, 2011

(87) PCT Pub. No.: WO2009/126155

PCT Pub. Date: Oct. 15, 2009

(65) Prior Publication Data

US 2011/0180276 A1 Jul. 28, 2011

(51) Int. Cl.

| | |
|---|---|
| ***A62C 35/00*** | (2006.01) |
| ***B01F 5/06*** | (2006.01) |
| ***B01F 13/00*** | (2006.01) |
| ***A62C 99/00*** | (2010.01) |
| ***A62C 35/02*** | (2006.01) |
| ***A62C 35/58*** | (2006.01) |
| ***A62C 35/68*** | (2006.01) |

(Continued)

(52) U.S. Cl.

CPC ..... *A62C 99/0018* (2013.01); *A62C 35/02* (2013.01); *A62C 35/023* (2013.01); *A62C 35/58* (2013.01); *A62C 35/68* (2013.01); *F15D 1/025* (2013.01); *F15D 1/14* (2013.01); *F15D 1/0015* (2013.01)

(58) Field of Classification Search

USPC ..... 169/5, 9, 14, 15, 16; 366/337–341

See application file for complete search history.

(56) References Cited

U.S. PATENT DOCUMENTS 1,473,052 A * 11/1923 Shaw ..... 48/189.4
2,924,938 A 2/1960 Herbert (Continued)

FOREIGN PATENT DOCUMENTS

WO WO-02078788 A2 10/2002

OTHER PUBLICATIONS

Internatioanl Preliminary Report on Patentability mailed Sep. 28, 2011.

(Continued)

*Primary Examiner* — Ryan Reis
(74) *Attorney, Agent, or Firm* — Cantor Colburn LLP

(57) ABSTRACT

A two-phase liquid/inert gas flow inerting fire suppression system is provided having improved liquid fire suppressant distribution within the inert gas flow. The system includes a flow distribution network having a first pipe interconnected with a second pipe at a flow splitting tee. A liquid flow redistribution device is disposed in the first pipe upstream with respect to fluid flow of the flow splitting tee.

6 Claims, 6 Drawing Sheets

(51) Int. Cl.

| | |
|---|---|
| ***F15D 1/02*** | (2006.01) |
| ***F15D 1/14*** | (2006.01) |
| ***F15D 1/00*** | (2006.01) |

(56) References Cited

U.S. PATENT DOCUMENTS

| | | | | | |
|---|---|---|---|---|---|
| 3,195,865 | A | | 7/1965 | Harder | |
| 3,406,947 | A | | 10/1968 | Harder | |
| 3,923,288 | A | | 12/1975 | King | |
| 4,220,416 | A | | 9/1980 | Brauner et al. | |
| 4,544,207 | A | * | 10/1985 | Litz | 299/5 |
| 4,898,512 | A | | 2/1990 | Geffs | |
| 5,250,104 | A | * | 10/1993 | Berger et al. | 95/254 |
| 5,709,468 | A | * | 1/1998 | Woerheide et al. | 366/337 |
| 6,044,910 | A | * | 4/2000 | Aebischer et al. | 169/14 |
| 6,427,930 | B1 | | 8/2002 | Mei et al. | |
| 6,708,727 | B2 | * | 3/2004 | Shiraishi et al. | 138/39 |
| 8,033,714 | B2 | * | 10/2011 | Nishioka et al. | 366/163.2 |
| 2004/0163825 | A1 | * | 8/2004 | Dunster et al. | 169/44 |
| 2005/0173131 | A1 | | 8/2005 | Dunster et al. | |
| 2007/0119433 | A1 | | 5/2007 | Popik et al. | |

OTHER PUBLICATIONS

Extended European Search Report, Supplementary European Search Report, and European Search Opinion for International Application No. PCT/US2008059815, Feb. 11, 2014, 6 pages.

International Search Report and Written Opinion mailed Aug. 6, 2008 (10 pgs.).

* cited by examiner

FIRE SUPPRESSION SYSTEM WITH IMPROVED TWO-PHASE FLOW DISTRIBUTION

FIELD OF THE INVENTION

This invention relates generally to fire suppression systems. More particularly, this invention relates to improved liquid distribution within the two-phase flow distribution network in an inerting fire suppression system.

BACKGROUND OF THE INVENTION

Fire suppression systems are commonly used in commercial buildings for extinguishing fires. In one type of fire suppression system, a jet of liquid fire extinguishing agent, most commonly water from a water supply tank, is injected into a high velocity stream of pressurized inert gas from an inert gas storage tank as the inert gas passes through a supply pipe forming part of a network of distribution pipes communicating with a network of discharge nozzles mounted to the distal ends of the respective distribution pipes. Upon interaction of the high velocity stream of inert gas with the water jet, the water droplets in the water jet are atomized into a mist of very small or minute droplets, thereby forming a two-phase mixture of water mist droplets entrained in and carried by the inert gas stream. This two-phase mixture is distributed via the network of distribution pipes to the discharge nozzles that are operatively associated with the region to be protected. The discharge nozzles distribute the water mist droplets and inert gas over a desired area to flood that area with water mist droplets and inert gas to extinguish a fire in the protected region.

The inert gas commonly used in conventional inerting fire suppression systems is nitrogen, but argon, neon, helium, carbon dioxide or other chemically non-reactive gas, or mixtures of any two or more of these gases may be used. The inert gas suppresses fire within the protected region by diluting the oxygen content within the protected region and also increasing the heat capacity per mole of oxygen within the protected region thereby raising the overall heat capacity of the atmosphere within the protected volume. Due to the presence of the water droplets, the two-phase mixture of water mist droplets and inert gas has a higher overall local heat capacity than the inert gas alone. Consequently, the two-phase mixture of water mist droplets and inert gas will more effectively absorb heat from the flame to the point that the temperature of the gas within the vicinity of the flame sheath drops below a threshold temperature below which combustion can not be sustained. International Patent Application No. PCT/GB02/01495, published as International Publication WO02/078788, for example, discloses a fire and explosion suppression system of the type hereinbefore described.

In such two-phase fire suppression systems, non-homogenous distribution of water mist droplets within the two-phase mixture of water mist droplets and inert gas flowing through the fluid distribution network may occur. In long horizontally extending stretches of pipe within the fluid distribution network, the water mist droplets may not be evenly distributed in the gas flow. For example, the water mist droplets may have a tendency to concentrate in the lower half of the two-phase flow passing therethrough. When a pipe junction is reached whereat the two-phase is divided, it is desired that the water mist droplets be divided proportionally with the split of the inert gas flow as it passes from the inlet pipe to the junction into the two outlet pipes leading from the junction, thereby maintaining a constant mass flow ratio of liquid to gas. However, if the water mist droplets are not relatively uniformly distributed in the flow entering the junction, the water will not proportionally distribute between the respective inert flows discharging through the junction. Such a disproportionate distribution of water between the respective downstream streams could result in some spray nozzles being supplied with an excessive amount of water while other spray nozzles are under supplied.

SUMMARY OF THE INVENTION

A fire suppression system for extinguishing a fire in a protected space includes a plurality of fluid discharge devices disposed in operative association with the protected space, and a flow distribution network for directing a flow of the inert gaseous fluid and liquid fire extinguishing agent, such as water or other fire extinguishing liquid, to the plurality of fluid discharge devices. The flow distribution network includes a first pipe interconnected in fluid communication with a second pipe at a flow splitting tee having an inlet leg for receiving fluid flow from the first pipe, a first outlet leg for discharging a first portion of the received fluid flow to a first segment of the second pipe, and a second outlet leg for discharging a second portion of the received fluid flow to a second segment of the second pipe. The liquid fluid flow redistribution device is disposed in the first pipe upstream with respect to fluid flow of the flow splitting tee.

In an embodiment, the liquid fluid flow redistribution device comprises a swirler device for imparting rotation to the liquid fluid flow passing through the first pipe.

In an embodiment, the liquid fluid flow redistribution device comprises an annular ring member having a circumferential base having a plurality of flow openings extending therethrough and a cylindrical flange extending axially outwardly from a radially inward portion of the annular ring member. The annular ring is disposed coaxially in the first pipe with an outer circumferential rim of the base in contact with an inner wall of the first pipe and the inner cylindrical flange extending axially upstream with respect to fluid flow through the first pipe.

In an embodiment, the liquid fluid flow redistribution device comprises a ramp extending circumferentially about and outwardly from an inner wall of the first pipe, with the ramp extending at an inward inclination in a downstream direction with respect to fluid flow through the first pipe. In an embodiment, the liquid fluid flow redistribution device comprises a recessed cavity formed in and extending circumferentially about an inner wall of the first supply pipe.

In an embodiment, the liquid fluid flow redistribution device comprises a venturi scoop device disposed coaxially within the first pipe and including a central passage therethrough having a throat section and disposed coaxially within the first pipe in spaced relationship with an inner wall of the first pipe so as to form a cavity between the inner wall and the channel member. A plurality of fluid flow openings are provided in the throat of the venturi device that pass through the channel member to establish fluid flow communication between the cavity and the central passage through the channel member. The venturi scoop device may comprise a longitudinally elongated shell defining a throat, a converging section extending axially in an upstream direction from the throat and a divergent section extending axially in a downstream direction from the throat.

In an embodiment, the liquid fluid flow redistribution device comprises a first perforated circular disc is disposed in the first pipe immediately upstream with respect to fluid flow of the inlet to the flow splitting tee. In an embodiment, a second perforated disc is disposed in the second pipe immediately downstream of the first outlet of the flow splitting tee, and a third perforated disc is disposed in the second pipe immediately downstream of the second outlet of the flow splitting tee.

In an embodiment, a flow turbulence generating device may be disposed in each of the second pipes downstream with respect to fluid flow of the flow splitting tee. In an embodiment, the flow turbulence generating device may be at least one vortex generating device. In an embodiment, the flow turbulence generating device may be a venturi device inserted in the pipe.

In an embodiment, a tubular liner may be disposed within the first pipe upstream with respect to fluid flow of the first perforated plate at the inlet to the flow splitting tee. The tubular liner has an outside diameter smaller than the inside diameter of the first pipe, whereby a first annular flow passage is defined between the tubular liner and the first pipe and a second inner passage is defined within and extending axially through the tubular liner. The inert gas flows through both the first annular flow passage and the second inner flow passage, while the water, or other liquid fire extinguishing agent, is only admitted into the inert gas flowing through the inner passage. A plurality of openings are provided in the tubular liner to define a plurality of flow passages through which inert gas may pass from the first annular flow passage into the inner flow passage to penetrate into the two-phase flow of water and inert gas passing through the inner flow passage. The openings in the tubular liner may be arranged at axially spaced intervals along the tubular liner and at circumferentially spaced intervals about the tubular liner, as desired. The openings may also be arranged in discrete sets of openings as desired.

BRIEF DESCRIPTION OF THE DRAWINGS

The following detailed description of the invention is to be read in connection with the accompanying drawing, where.

DETAILED DESCRIPTION OF THE INVENTION

Figure 1:
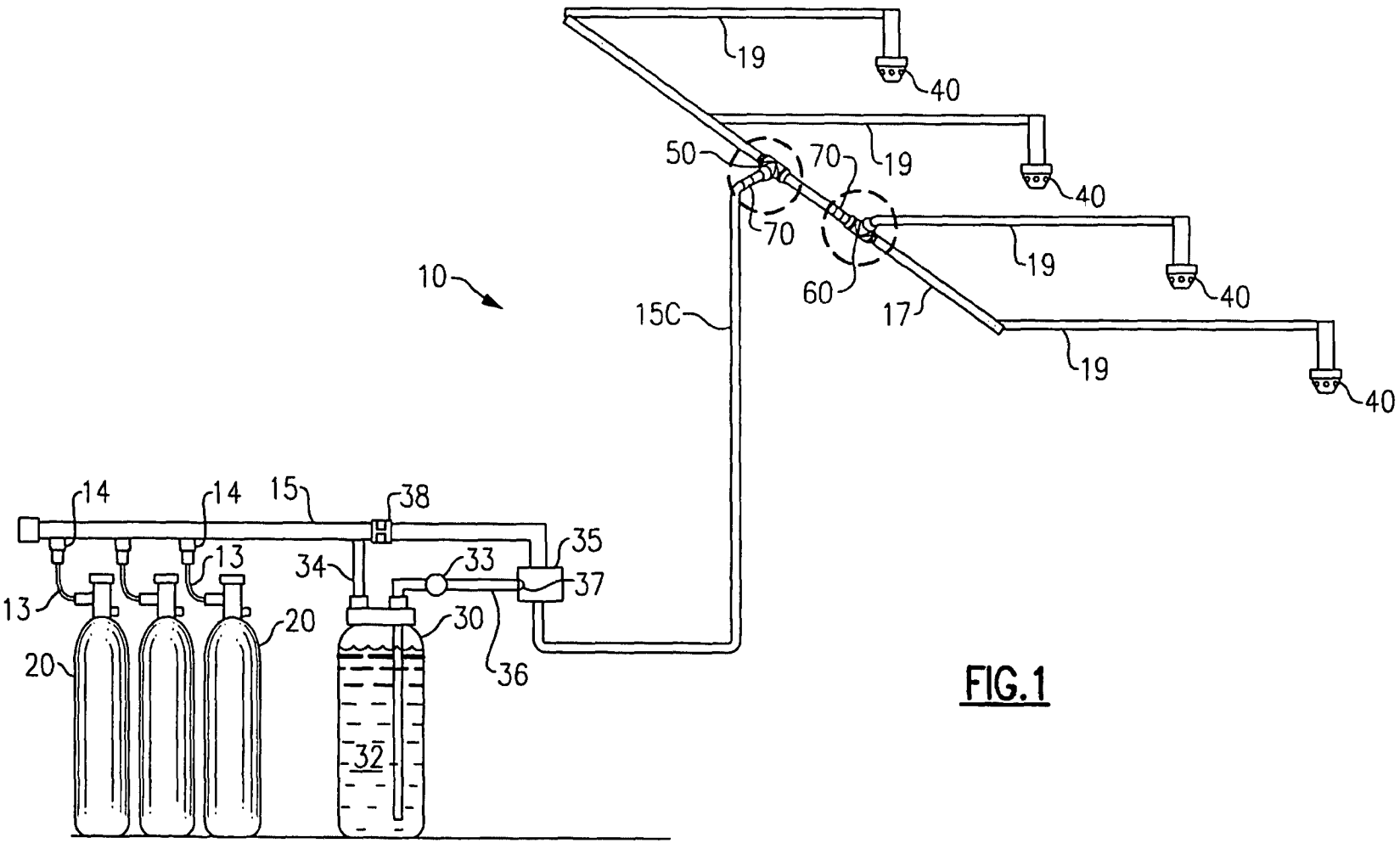
FIG. 1 is a depiction, partly is schematic and partly in perspective, of a first exemplary embodiment of an inerting fire suppression system in accord with the invention.
Figure 8:
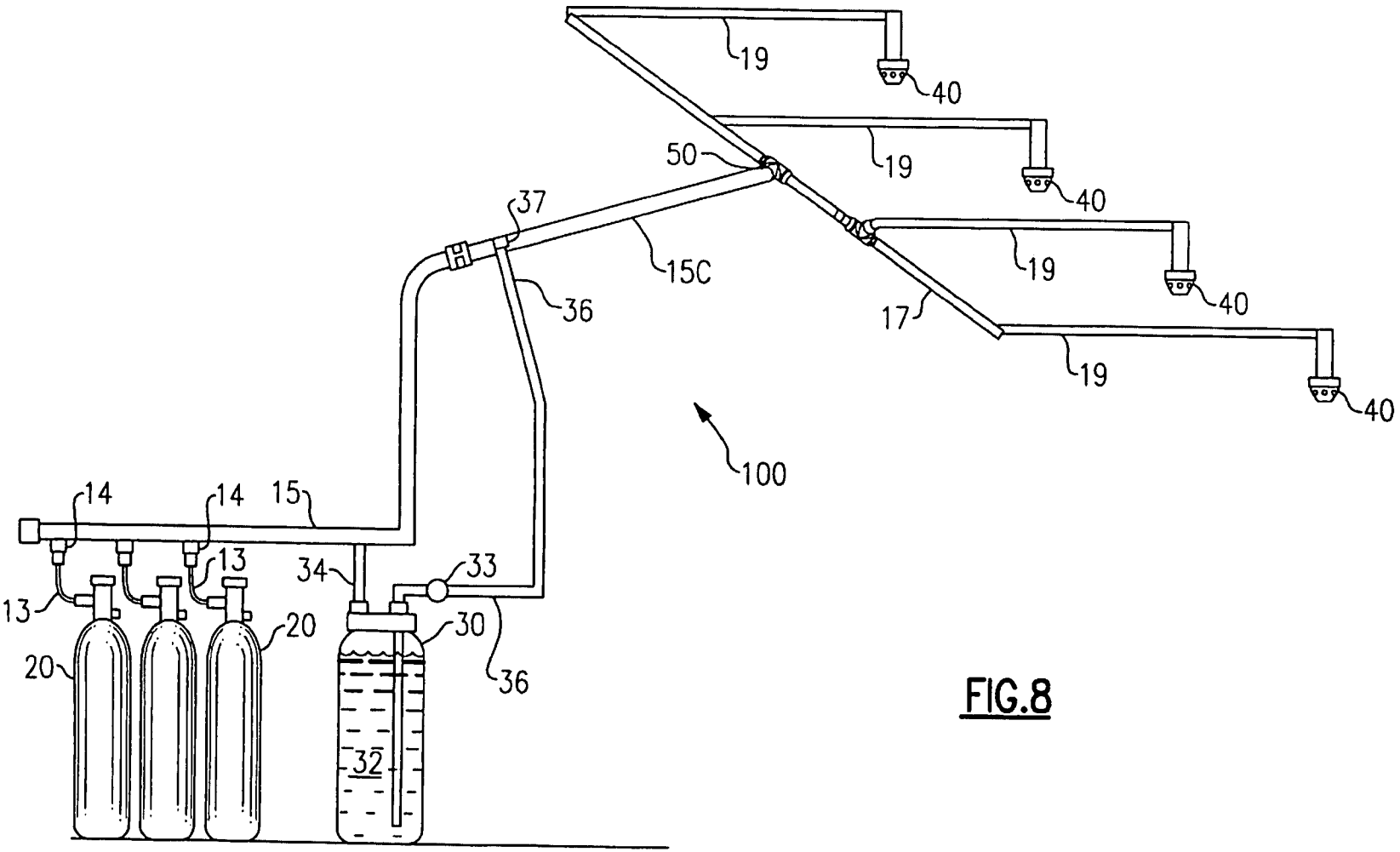
FIG. 8 is a depiction, partly is schematic and partly in perspective, of a second exemplary embodiment of an inerting fire suppression system in accord with the invention.

Referring now to FIGS. 1 and 8, in particular, there are depicted first and second exemplary embodiments, respectively, of a two-phase inerting fire suppression system 10. Each of the exemplary embodiments of the fire suppression system 10 includes one or more vessels 20 for storing an inert gas, that is a chemically non-reactive gas, such as nitrogen, argon, neon, helium, or a mixture of two or more of these gases, a water storage vessel 30, and at least one discharge device 40 disposed within the region to be protected. However, except when the region to be protected is a single rather small room, a plurality of discharge devices would generally be provided within the region to be protected, with one or more discharge devices provided per room defined within the protected region.

The inert gas storage vessels 20 are connected in parallel arrangement in flow communication with the spray nozzle assemblies 40 via an inert gas distribution network made of a supply pipe 15, an intermediate distribution pipe 17 and a plurality of circuit pipes 19. The inert gas supply pipe 15 at its terminus is in fluid flow communication with the intermediate distribution pipe 17. Each of the circuit pipes 19 branches off from and is in fluid flow communication with the intermediate distribution pipe 17 and has a terminus disposed within the space to be protected to which a respective one of the spray nozzles is mounted. As will be explained in further detail later, when a fire is detected within the space to be protected, inert gas under pressure within the inert gas vessels 20 passes therefrom through the supply pipe 15 to and through the intermediate distribution pipe 17 and thence to and through each of the circuit pipes 19 which feed the inert gas to a respective one of the spray nozzle assemblies 40.

Each of the inert gas storage vessels 20 has its gas outlet connected via a branch supply line 13 in flow communication with the supply pipe 15. A check valve 14 may be disposed in each branch supply line 13 for allowing the inert gas to flow from the respective inert gas storage vessel 20 associated therewith through branch supply line 13 into the inert gas supply pipe 15, but not to flow back into the inert gas storage vessel. Each of the inert gas storage vessels 20 may be equipped with an outlet valve 16 to regulate the gas discharge pressure. If desired, the outlet valve 16 may also be designed to control the rate of inert gas flow from the storage vessel associated therewith.

Figure 2A:
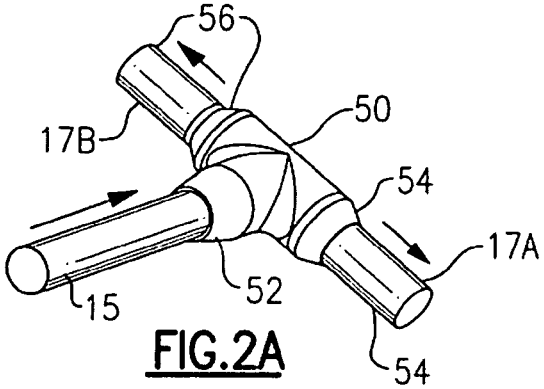
FIG. 2A is a depiction in perspective of a first embodiment of a flow splitting tee of the inert gas distribution network shown in FIG. 1.
Figure 2B:
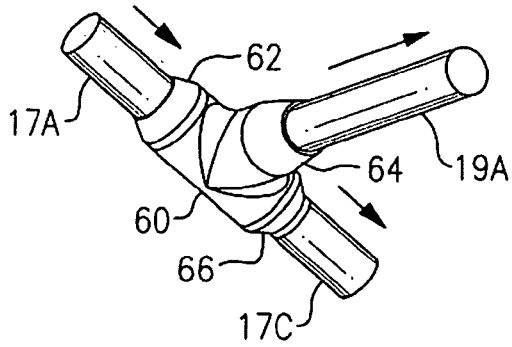
FIG. 2B is a depiction in perspective of a second embodiment of a flow splitting tee of the inert gas distribution network shown in FIG. 1.

In the depicted embodiment, the supply pipe 15 and the intermediate distribution pipe 17 intersect in a T-shaped arrangement with the supply pipe 15 connected to the inlet leg 52 of the bull tee 50 and segments 17A and 17B of the intermediate distribution pipe 17 connected to the respective two outlet legs 54, 56 of the bull tee 50, as illustrated in FIG. 2A. In the depicted embodiment, the circuit pipe 19A intersects the intermediate distribution pipe 17 in a T-shaped arrangement with the upstream segment 17A of the intermediate distribution pipe 17 connected to the inlet leg 62 of the tee 60 and the downstream segment 17C of the intermediate distribution pipe 17 connected to one outlet leg 64 of the side tee 60 and the circuit pipe 19A connected to the other outlet leg 66 of the side tee 60, as illustrated in FIG. 2B.

The two-phase fluid received from the inert gas supply pipe 15 through the inlet leg 52 of the bull tee 50 splits into two portions, one portion discharging through the first outlet leg 54 of the bull tee 50 into segment 17A of the intermediate distribution pipe 17 and the other portion discharging through the second outlet leg 56 of the bull tee 50 into segment 17B of the intermediate distribution pipe 17. The two-phase fluid received from the upstream segment 17A of the intermediate distribution pipe 17 through the inlet leg 62 of the side tee 60 splits into two portions, one portion discharging through the first outlet leg 64 of the side tee 60 into the circuit pipe 19A and the other portion discharging through the second outlet leg 66 of the side tee 60 into downstream segment 17C of the intermediate distribution pipe 17.

The water storage vessel 30 defines an interior volume 32 wherein a supply of water is stored. A gas inlet line 34 establishes flow communication between the inert gas supply pipe 15 and an upper region of the interior volume 32 of the water storage vessel 30. A water outlet line 36 establishes flow communication between a lower region of the interior volume of the water storage vessel 30 and the inert gas distribution network at a location downstream with respect to inert gas flow of the location at which the gas inlet line 34 taps into the inert gas supply line 15. Additionally, a flow restriction device 38 may be disposed in the inert gas distribution network at a location between the location upstream thereof at which the gas inlet line 34 taps into the supply line 15 and the location downstream thereof at which the water outlet line 36 opens into the inert gas distribution network. The flow restriction device 38, which may, for example, comprise a fixed orifice device interdisposed in the inert gas supply line 15, causes a pressure drop to occur as the inert gas traverses the flow restriction device 38, whereby a gas pressure differential is established between the upstream location at which the gas inlet line 34 taps into the inert gas supply pipe 15 and the downstream location at which the water outlet line 36 opens into the inert gas distribution network.

A spray nozzle 37 may be mounted to the outlet end of the water outlet line 36 to atomize or otherwise produce a mist of water droplets as the water from the supply tank 30 is introduced into the inert gas flow. In the embodiment of the fire suppression system 10 depicted in FIG. 1, the water outlet line 36 opens into a mixing chamber 35 disposed in the inert gas supply pipe 15 of the inert gas distribution network at a location downstream with respect to gas flow of the flow restriction device 38. However, it is to be understood that a defined mixing chamber 35 is not required to carry out the invention. Rather, as in the embodiment of the fire suppression system 10 depicted in FIG. 8, the water outlet line 36 may discharge directly into the interior volume defined by the inert gas supply pipe 15 with the water from the water tank 30 passing from the water outlet line 36 through spray nozzle 37 directly into the inert gas flow passing through the supply pipe. The spray nozzle 37 converts the water into a mist of droplets and sprays the droplets into the flow of inert gaseous fluid passing through the mixing chamber 35 or the inert gas supply pipe 15, thereby forming a two-phase fluid flow which continues through the supply pipe 15 and the remainder of the flow distribution network to the plurality of spray nozzles 40. A flow control device 33 may be disposed in the water outlet line 36 to regulate the amount of water flowing therethrough.

The length of travel of the two-phase flow from the point of injection of the water into the inert gas through section 15C of the inert gas supply pipe 15 to its passing into the intermediate distribution pipe 17 for distribution amongst the various spray nozzles 40 via the respective circuit pipes 19 may be several meters, for example up to 20 or more meters depending upon the system design. In the course of traversing this path through section 15C of the inert gas supply pipe 15, the water droplets and inert gas may separate to varying degree. In some instances, the water droplets may coalesce and concentrate as a liquid film flowing along the inner wall defining the flow passage of section 15C of the gas supply pipe 15 forming a tunnel about a core flow of inert gas. In other instances, particularly in horizontal runs of pipe, the water droplets may concentrate primary along a lower arc portion of the wall with the inert gas flowing thereover. In still other instances, the water droplets may concentrate in a plug flow along the axis of supply pipe with the inert gas flowing circumferentially about the flow of water droplets.

At each of the pipe intersections within the fluid distribution network, the incoming two-phase fluid flow is split into two ongoing flows. For example, the two-phase fluid received through the inlet leg 52 of the bull tee 50 splits into two portions, one portion discharging through the first outlet leg 54 of the bull tee 50 into segment 17A of the intermediate distribution pipe 17 and the other portion discharging through the second outlet leg 56 of the bull tee 50 into segment 17B of the intermediate distribution pipe 17. In conventional two-phase flow inerting systems, because the distribution of the liquid film on the inner wall of the pipe is generally not uniform as the flow enters the flow splitting tee, the potential exists for an unequal distribution of the liquid phase to occur between the two-phase flows discharging from the flow splitting tee. Applicants have determined that the occurrence of such an unequal distribution of liquid phase between the two outgoing flows may be diminished by affecting a redistribution of the liquid phase of the two-phase flow upstream of the flow splitting tee.

To reduce, if not eliminate, the potential for unequal distribution of the liquid phase in the outgoing two-phase fluid flows leaving a flow splitting tee at a pipe intersection in the fluid distribution network of the system 10, a liquid fluid flow redistribution device 70 is disposed in the particular pipe feeding the two-phase flow to the inlet leg of the flow splitting tee at a location upstream of the intersection. For example, a liquid fluid flow redistribution device 70 may be disposed in the supply pipe 15 downstream with respect to fluid flow of the introduction of the liquid fluid flow into the flow of the inert gaseous fluid passing through the supply pipe 15 and upstream of the bull tee 50 to reduce the unequal distribution of the water between the outgoing two-phase fluid flows at the bull tee 50. In an embodiment, as illustrated in FIG. 1, the liquid flow redistribution device 70 may be disposed at or within a few pipe diameters of the intersection of the supply pipe 15 with the intermediate distribution pipe 17. The liquid fluid flow redistribution device 70 functions to provide a more uniform distribution of water in the fluid flow passing through the supply pipe 15 downstream of the device.

Similarly, to reduce, if not eliminate, the potential for unequal distribution of the liquid phase between the outgoing two-phase fluid flows at the intersection of the intermediate distribution pipe 17 and one or more circuit pipes 19 in the fluid distribution network of the fire suppression system 10, a liquid fluid flow redistribution device 70 may be disposed in the intermediate distribution pipe 17. In an embodiment, as illustrated in FIG. 1, the liquid flow redistribution device 70 may be disposed at or within a few pipe diameters upstream of the side tee 60 defining the intersection of the circuit pipe 19 with the intermediate distribution pipe 17. At this location, the liquid fluid flow redistribution device 70 functions to provide a more uniform distribution of water between the flow passing into the circuit pipe 19A and the flow passing into the intermediate distribution pipe 17C downstream of the device.

Figure 3:
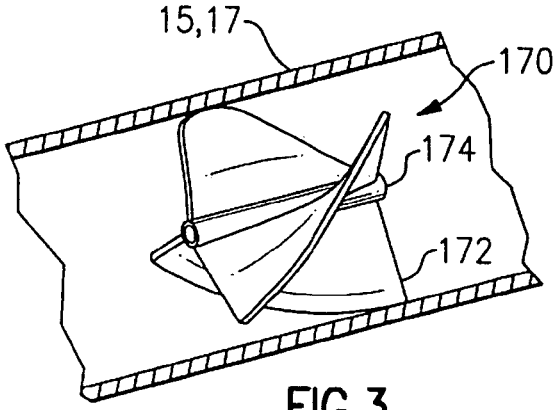
FIG. 3 is a perspective view of a first exemplary embodiment of a liquid flow redistribution device.

In an aspect of the invention, the liquid fluid flow redistribution device may be any device that when disposed in the two-phase flow passing through the inert gas distribution network redistributes water flowing along the inner wall of the pipe into a film distributed uniformly about the circumference of the inner wall of the pipe as the flow enters a flow spitting tee. For example, referring now to FIG. 3, the liquid fluid flow redistribution device may comprise a swirler device 170 having a plurality of curved vanes 172 mounted to an axial shaft 174. In application, the swirler device 170 is disposed in the flow path of the two-phase flow with the shaft 174 aligned along the axis of the pipe and the outboard edges 176 of the curved vanes 172 abutting the inner wall of the pipe, 15, 17. As the flow traverses the swirler device 170, a vanes 172 impart a swirl to the two-phase flow and also to any water flowing along the inner wall of the pipe, thereby affecting a channeling of the water as a result of the imparted swirl into a film distributed uniformly about the circumference of the inner wall of the pipe as the flow traverses the swirler device 170. The location of placement upstream of the pipe intersection defined by the flow splitting tee 50, 60 will generally be at a few pipe diameters upstream from the intersection. The exact placement of the swirler device, as well as the swirler vane dimensions and the swirl angle of the vanes 172, may be varied as desired to optimize the effect of the swirl in any particular application.

Figure 4:
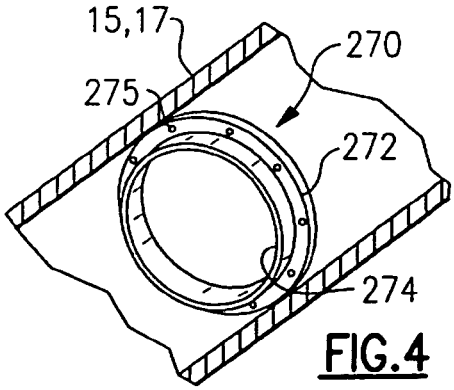
FIG. 4 is a perspective view of a second exemplary embodiment of a liquid flow redistribution device.

In another embodiment, as depicted in FIG. 4, the liquid fluid flow redistribution device may comprise an annular ring member 270 having a circumferential washer-like base 272 and a flange 274 extending axially outward from a face of the base 272 along the inner circumference of the base 272. The annular ring member 270 is positioned within the pipe 15, 17 with the outer circumferential rim of the base 272 abutting the inner wall of the pipe 15, 17 and with the flange 274 extending in the upstream direction with respect to fluid flow through the pipe in space relationship with the inner wall of the pipe thereby forming a circumferential channel between the flange and the inner wall of the pipe. A plurality of openings 275 are provided in and extend through the base 272 outboard of the flange 274 to provide a plurality of flow openings therethrough. In operation, water flowing along the inner wall of the pipe from the upstream direction collects in the circumferential channel and passes through the openings 275 to form a film of water distributed uniformly about the circumference of the inner wall of the pipe about a core flow of two-phase flow of water droplets and inert gas passing through the central opening 277 of the annular ring member 270. Although shown as a plurality of circular holes disposed at uniformly spaced circumferential intervals about the base 272, it is to be understood that the openings 275 may be slots or of other shape, and that the number, size and spacing of the openings 275 may be varied as desired to optimize the effect of the annular ring member 270 in any particular application.

In another aspect of the invention, the liquid fluid flow redistribution device may be any device that when disposed in the two-phase flow passing through the inert gas distribution network redirects water flowing along the inner wall of the pipe into the core two-phase flowing of water droplets and inert gas flowing through the pipe. For example, referring now to FIGS. 5 and 6, the liquid fluid flow redistribution device 70 may comprise a discontinuity in the inner wall of the pipe that results in turbulent eddies or unsteady vortex shedding of liquid passing along the inner wall as it traverses the discontinuity. As a result of the turbulence generated, the water departs from the inner wall as it traverses the discontinuity and is re-entrained in the core two-phase flow passing through the pipe.

Figure 5:
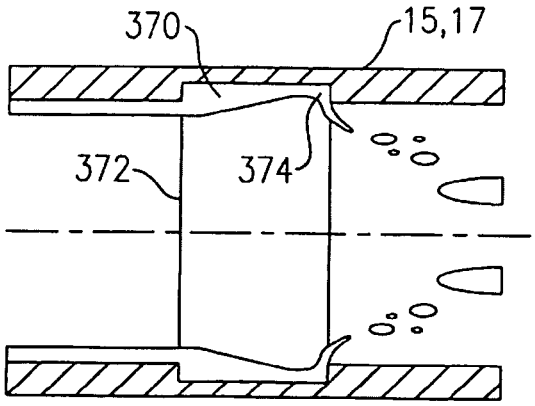
FIG. 5 is a perspective view of a third exemplary embodiment of a liquid flow redistribution device.

For example, the liquid fluid flow redistribution device may comprise an annular recessed cavity 370 extending in a band-like fashion about the circumference of the inner wall of the pipe 15, 17 as depicted in FIG. 5. When the water flowing along the inner wall of the pipe encounters the upstream lip 372 of the recessed cavity 370, the water flows into the cavity 370 and then encounters the downstream lip 374 of the recessed cavity when exiting the cavity. The water sheds off the downstream lip 374 of the cavity 370 and, rather than reattaching to inner wall of the pipe, is re-entrained in the core two-phase flow due to the turbulence of the unsteady vortex eddies generated by the discontinuity in the surface of the inner wall created by the annular recessed cavity 370.

Figure 6:
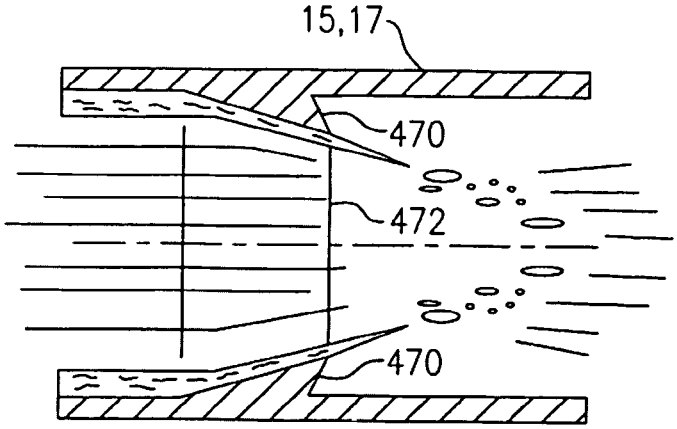
FIG. 6 is a perspective view of a fourth exemplary embodiment of a liquid flow redistribution device.

In another embodiment, the liquid fluid flow redistribution device may comprise a ramp 470 extending in band-like fashion about the circumference of the inner wall of the pipe 15, 17 as depicted in FIG. 6. When the water flowing along the inner wall of the pipe encounters the ramp 470, the water flows along the inwardly inclined surface of the ramp. As the water leaves the downstream lip 472 of the ramp, rather than reattaching to inner wall of the pipe, the water is re-entrained in the core two-phase flow due to the turbulence of the unsteady vortex eddies generated by the discontinuity in the surface of the inner wall created by the ramp 470. Additionally, the inward inclination of the ramp 470 serves to redirect the flow of water away from the wall and into the core flow of two-phase fluid passing through the pipe 15, 17.

Figure 7:
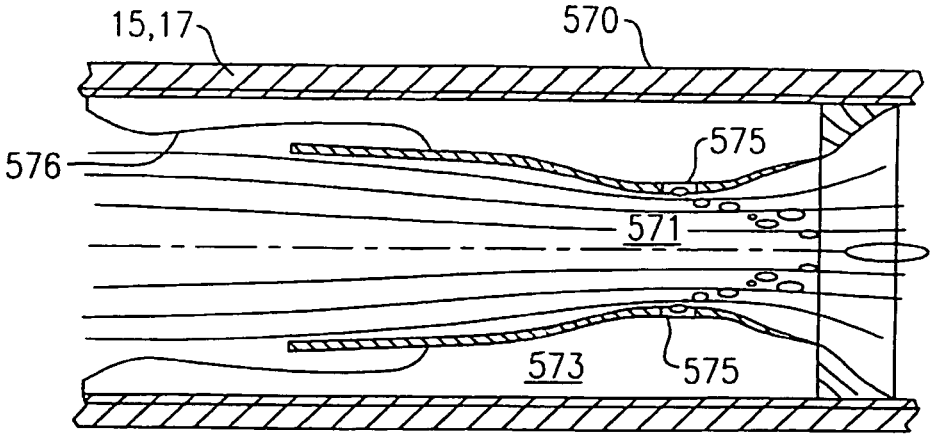
FIG. 7 is a perspective view of a fifth exemplary embodiment of a liquid flow redistribution device.

In yet another embodiment, the liquid fluid flow redistribution device may comprise a venturi scoop device 570 such as depicted in FIG. 7. The venturi scoop device 570 includes a longitudinally extending body 572 defining a throat section 571 and disposed axially within the pipe 15, 17 in spaced relationship with the inner wall of the pipe thereby forming a cavity 573 between the inner wall of the pipe and the outer wall of the body 572. The downstream end of the cavity 573 is closed by an annular ring 574 abutting the downstream end of the body 572. A plurality of support members 576, typically 2, 3 or 4 in number, extend radially between the outer wall of the body 572 and the inner wall of the pipe to support the body 572 therefrom. A plurality of openings 575 are provided at circumferentially spaced intervals about and extend through the throat section 571 that provide flow passages linking the cavity 573 in fluid communication with the flow passage through the throat section 571.

When the water flowing along the inner wall of the pipe encounters the venturi scoop 570, the water collects in the cavity 573. As the core flow of two-phase fluid passes through the throat section 571, a low pressure zone is created at the throat of the venturi section. As a result of the pressure differential between the cavity 573 and the low pressure zone within the throat section 571, water collecting in the cavity 573 discharges therefrom through the plurality of openings 575 and is re-entrained in the core two-phase flow. Although shown as a plurality of circular holes disposed at uniformly spaced circumferential intervals about the throat of the throat section 571, it is to be understood that the openings 575 may be slots or of other shape, and that the number, size and spacing of the openings 575 may be varied as desired to optimize the effect of the venturi scoop device 570 in any particular application.

Figure 10:
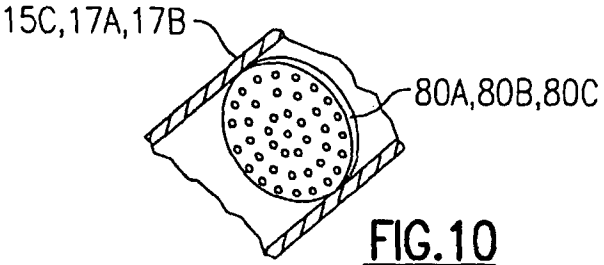
FIG. 10 is a perspective view of a sixth exemplary embodiment of a liquid flow redistribution device.
Figure 9:
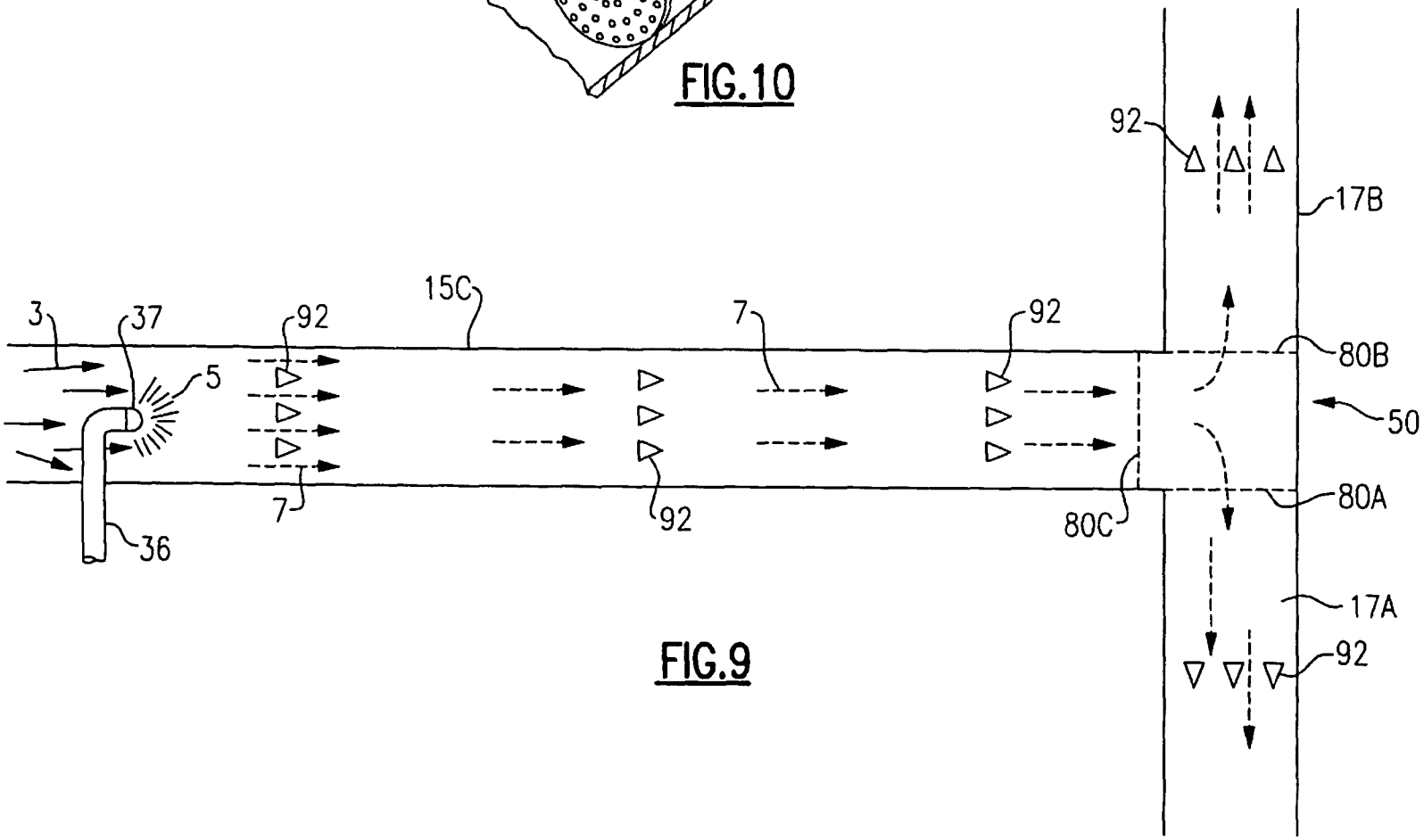
FIG. 9 is an elevation view, partly in section, of a first exemplary embodiment of a portion of the inert gas distribution network of FIG. 8 upstream and downstream of the flow splitting tee.

In an embodiment of the fire suppression system, perforated discs 80A, 80B, 80C are disposed in the two-phase flow streams entering and leaving the flow splitting tee 50 to promote a more uniform distribution of the two-phase flow 7 leaving the flow splitting tee 50. Referring now to FIG. 9, a perforated circular disc 80A is disposed in the distribution pipe 17A immediately downstream with respect to fluid flow of the outlet of the flow splitting tee opening to the distribution pipe 17A, a perforated circular disc 80B is disposed in the distribution pipe 17B immediately downstream with respect to fluid flow of the outlet of the flow splitting tee opening to the distribution pipe 17B, and a perforated circular disc 80C is disposed in the supply pipe 15C immediately upstream with respect to fluid flow of the inlet to the flow splitting tee opening to the supply pipe 15C. Referring now to FIG. 10, each of the circular discs 80 is perforated with a plurality of openings 85, such as but not limited to a plurality of circular holes, that provide a plurality of discrete flow paths. Each of the openings 85 provides a flow restriction through which the two-phase flow must pass. As the two-phase flow traverses the openings 85, each of the individual flow streams undergoes a pressure drop and then expands in turbulent eddies as it exits the opening. The turbulence functions to enhance mixing of the water and inert gas in the two-phase flow. The perforated discs 80, in combination, provide a series of pressure drops that the flow must traverse in a very short distance which acts to more evenly distribute the flow entering the flow splitting tee between the two streams exiting from the flow splitting tee 50.

The perforated disc 80A disposed upstream of the flow splitting tee 50 promotes a more uniform distribution of the two-phase fluid and breaks up any relatively larger water droplets into relatively smaller droplets. Having passed through the upstream perforated disc 80A and entered the flow splitting tee 50, the two-phase flow impinges on the opposite wall of the tee and splits into two flows passing out of the tee 50 in opposite directions. Each of the perforated plates 80B and 80C disposed downstream of the flow splitting tee 50 promotes a more uniform distribution of the two-phase fluid following the impingement and flow splitting within the tee 50 and breaks up any relatively larger water droplets that may have formed as a result of coalescence of smaller water droplets due to inelastic collisions of smaller water droplets within the flow splitting tee 50.

In addition, vortex generating devices may be disposed in flow path of the two-phase flow passing through the supply pipe 15 at a location upstream of the inlet to the flow splitting tee 50. For example, in the exemplary embodiment depicted in FIG. 9, a series of vortex generating devices 92 are disposed at axially spaced intervals along the length of the segment 15C of the supply pipe 15 from a location downstream of the point at which the water, or other liquid fire extinguishing agent is introduced into the inert gas flow and a location upstream of the perforate circular disc 80C. As the two-phase flow traverses the vortex generating devices 92, unsteady flow vortices are generated in the two-phase flow which enhance mixing of the liquid phase and the gas phase to ensure a more uniform distribution of liquid mist droplets through out the inert gas passing into the flow splitting tee 50.

Figure 11:
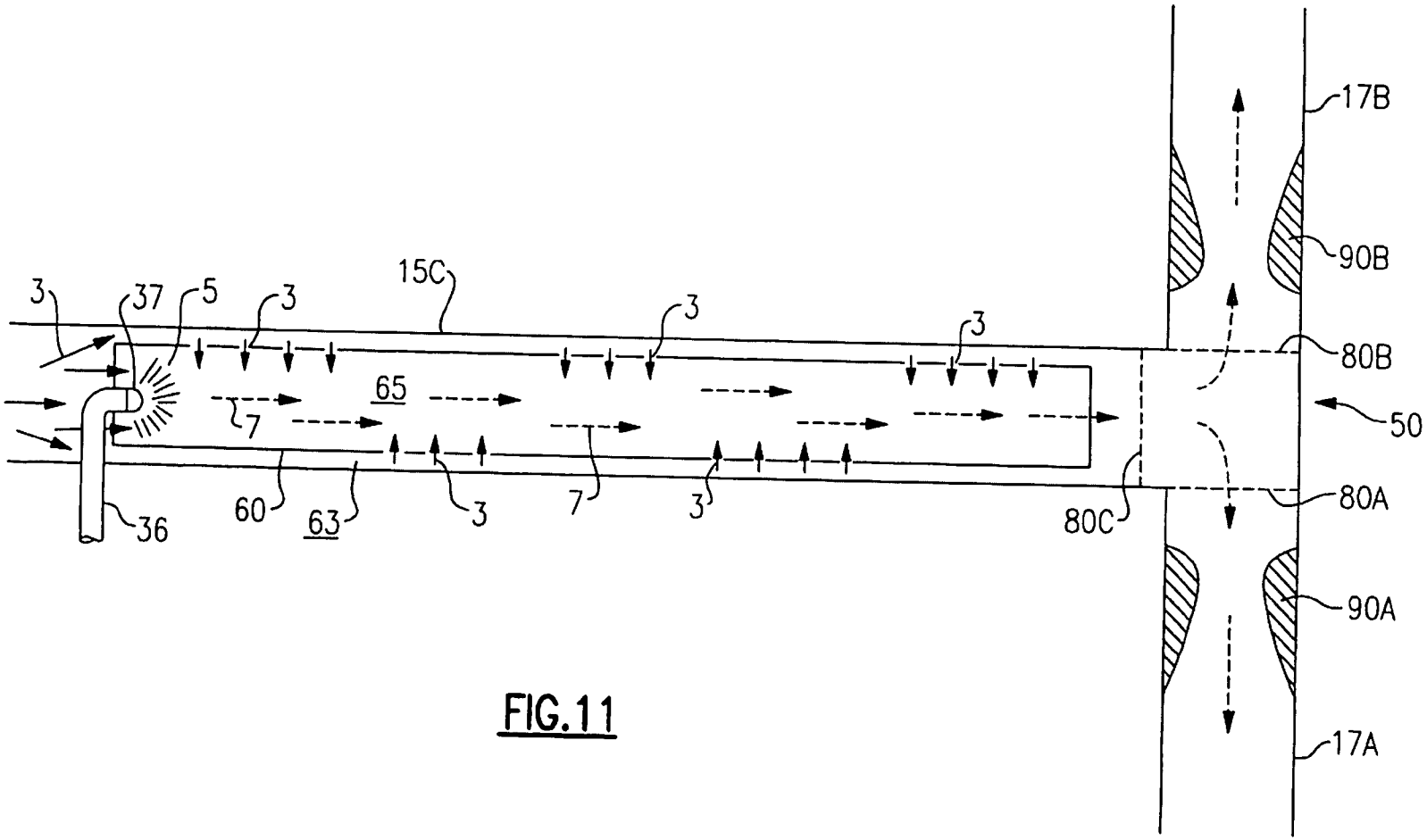
FIG. 11 is an elevation view, partly in section, of a second exemplary embodiment of a portion of the inert gas distribution network of FIG. 8 upstream and downstream of the flow splitting tee.

In the exemplary embodiment of the fire suppression system depicted in FIG. 11, an inner tubular liner 60 is disposed coaxially within segment 15C of the inert gas supply pipe 15. The inner tubular liner 60 defines an axially elongated inner fluid flow passage 65 bounded by its inner diameter. The inner tubular liner 60 has an outer diameter that is smaller than the inner diameter of segment 15C of the inert gas supply 15. Therefore, an annular flow passage 55 is defined within the inert gas supply pipe 15 between the inner wall of the inert gas supply pipe 15 and the outer wall of the inner tubular liner 60. The inner tubular liner 60 extends coaxially within the segment 15C of the inert gas supply pipe 15 from a location downstream with respect to fluid flow of the point of injection of water, or other liquid fire extinguishing agent, into the inert gas flow to a location slightly upstream with respect to fluid flow of the inlet to the flow splitting tee at the intersection of the main supply pipe 15 with the intermediate distribution pipe 17. For example, the tubular liner 60 may extend from 5 to 10 inner diameters of the segment 15C of the inert gas supply pipe 15.

Thus, both the annular flow passage 55 defined between the inner diameter segment 15C of the inert gas supply pipe 15 and the outer diameter of the tubular liner 60 and the inner passage 65 defined within the inner tubular liner 60 open to the upstream portion of the inert gas supply pipe 15 and receive inert gas flow from the upper stream portion of the inert gas supply pipe. A first portion of the inert gas flow passing through the inert gas supply pipe 15 enters into and traverses the inner flow passage 65 through segment 15C of the inert gas supply pipe 15 and a second portion of the inert gas passing through the inert gas supply pipe 15 enters into and traverses the annular flow passage 55 defined within segment 15C of the inert gas supply pipe. However, the discharge outlet of the water outlet line 36, or the atomizing nozzle 37 if mounted thereto, opens into the inner flow passage 65 at a location slightly downstream of the mouth 61 of the inner tubular liner 60 of the inert gas supply pipe 15. Thus, the droplets 5 in the mist of water, or other liquid fire extinguishing agent, introduced into the portion of the inert gas flow passing through the inner flow passage 65 mixes with the inert gas 3 to form a two-phase flow 7 of liquid mist droplets entrained in the inert gas flowing through the inner flow passage 65. Therefore, inert gas 3 only flows through the annular flow passage 55 bounded by the inner wall of segment 15C of the inert gas supply pipe 15 and the outer diameter of the inner tubular liner 60, while a two-phase flow 7 of liquid mist droplets entrained in inert gas flows through the fluid flow passage 65 extending axially within the inner tubular liner 60.

Additionally, a plurality of openings 67 are provided in the wall of the inner tubular liner 60. The openings 67 provide fluid flow communication between the annular flow passage 55 and the inner flow passage 65 defined within the inner tubular liner 60. The openings 60 are arranged at axially spaced intervals along the length of the tubular liner 60 and at circumferentially spaced intervals about the circumference of the tubular liner 60. In operation of the fire suppression system 10, a portion of the inert gas 3 flowing through the annular flow passage 55 passes through each of the openings 67 and into the inner flow passage 65 to discharge into and admix with the two-phase flow 7 of liquid and inert gas flowing through the inner flow passage 65. Thus, a series of jets of inert gas discharge into the two-phase flow at spaced intervals along the length of and about the circumference of the inner tubular liner 60. These jets of inert gas serve to break-up any water film that may be flowing along the inner wall of the inner tubular liner 60. Additionally, as the inert gas jets penetrate into the two-phase flow, the resulting turbulence in the two-phase flow serves to induce further intermixing of the liquid mist droplets and the inert gas to enhance uniformity in distribution of the liquid droplets in the inert gas flow.

The individual openings 67 or sets of openings 61 may be arranged in any configuration as desired. In the exemplary embodiment depicted in FIG. 11, the openings 67 are aligned in two axially extending rows disposed diametrically opposite each other and are arranged in subgroups 61 of three or four openings 67 each with the subgroups 61 axially spaced apart at a desired interval. However, it is to be understood that the particular arrangement of individual openings 67 or subgroups 61 of openings, including but not limited to the number of rows of openings, the circumferential arrangement of the respective rows, the number of subgroups within a row, if any, and the number of openings in a subgroup, the spacing between subgroups and individual openings, or any other facet of the arrangement may be varied as desired for a particular application. Further, it is to be understood that the openings 18 may be circular holes, elongated slots or of other shape, and that the size of the openings 18 may be varied as desired to optimize performance in any particular application.

To reduce, if not eliminate, the potential for unequal distribution of the liquid phase in the two-phase fluid flows in the distribution pipes 17A and 17B downstream of the respective outlets of the flow splitting tee 50 at the intersection of the inert gas supply pipe 15 and the distribution pipe 17, an additional flow turbulence generating device, such as for example a venturi device 90 or a vortex generating device 92, may be disposed in each of the particular pipes receiving the two-phase flow from the flow splitting. For example, in the exemplary embodiment illustrated in FIG. 9, a vortex generating device 92A is disposed within the distribution pipe 17A within a few pipe diameters of the entrance of the two-phase flow to the distribution 17A from the outlet leg 54 of the flow splitting tee 50. Similarly, a vortex generating device 92B is disposed within the distribution pipe 17B within a few pipe diameters of the entrance of the two-phase flow to the distribution 17B from the outlet leg 56 of the flow splitting tee 50. In the exemplary embodiment illustrated in FIG. 11, a venturi device 90A is disposed within the distribution pipe 17A within a few pipe diameters of the entrance of the two-phase flow to the distribution 17A from the outlet leg 54 of the flow splitting tee 50. Similarly, a venturi device 90B is disposed within the distribution pipe 17B within a few pipe diameters of the entrance of the two-phase flow to the distribution 17B from the outlet leg 56 of the flow splitting tee 50.

As the two-phase flows passing from the flow splitting tee 50 traverses the venturi devices 90 or the vortex generating devices 92, unsteady flow vortices are generated in the two-phase flow which enhance mixing of the liquid phase and the gas phase to ensure a more uniform distribution of liquid mist droplets through out the inert gas passing to the spray nozzles 40. As noted previously, coalesced droplets of water, or other fire extinguishing fluid, that may have formed as a result of the inelastic collisions of finer mist droplets, are broken up as a result of the two-phase flow passing through the openings in the perforated circular discs 80A and 80B. Being positioned slightly downstream of these perforated circular discs, the flow turbulence generating devices 90, 92 facilitate the mixing and redistribution of the finer droplets resulting from the break-up of the coalesced droplets into the inert gas flow.

The inerting fire suppression system of the invention has been described with reference to water as the liquid fire extinguishing agent. It is to be understood that other liquid fire extinguishing agents may be used instead of water in the inerting fire suppression system of the invention. As those skilled in the art will recognize, the teachings of the invention may be applied to any two-phase fluid inerting fire suppression system wherein a maldistribution of liquid fire extinguishing agent amongst various branches or circuits of the system may potentially occur.

While the present invention has been particularly shown and described with reference to the exemplary embodiments as illustrated in the drawing, it will be understood by one skilled in the art that various changes in detail may be effected therein without departing from the spirit and scope of the invention as defined by the claims.

We claim:

1. A fire suppression system for extinguishing a fire in a protected space, comprising:

a plurality of fluid discharge devices disposed in operative association with the protected space;

a flow distribution network for directing a two-phase flow of an inert gaseous fluid and liquid fire extinguishing agent to said plurality of fluid discharge devices, the flow distribution network including a first pipe receiving the flow of the inert gaseous fluid and liquid fire extinguishing agent and defining a first flow passage interconnected at a flow splitting tee in fluid communication with a second pipe defining a second flow passage and a third flow passage, the flow splitting tee having an inlet for receiving fluid flow from the first flow passage, a first outlet for discharging a first portion of the received fluid flow to the second flow passage, and a second outlet for discharging a second portion of the received fluid flow to the third flow passage; and a liquid fluid flow redistribution device disposed in the first pipe upstream with respect to fluid flow of the flow splitting tee;

wherein said liquid fluid flow redistribution device comprises an annular ring member having a circumferential base and a cylindrical flange extending axially outwardly from a radially inward portion of the annular ring member, said annular ring disposed coaxially in the first pipe with an outer circumferential rim of said base in contact with an inner wall of the first pipe and said cylindrical flange extending axially upstream with respect to fluid flow through the first pipe, said base having a plurality of flow openings formed therein radially outwardly of the cylindrical flange.

2. A fire suppression system for extinguishing a fire in a protected space, comprising:

a plurality of fluid discharge devices disposed in operative association with the protected space;

a flow distribution network for directing a two-phase flow of an inert gaseous fluid and liquid fire extinguishing agent to said plurality of fluid discharge devices, the flow distribution network including a first pipe receiving the flow of the inert gaseous fluid and liquid fire extinguishing agent and defining a first flow passage interconnected at a flow splitting tee in fluid communication with a second pipe defining a second flow passage and a third flow passage, the flow splitting tee having an inlet for receiving fluid flow from the first flow passage, a first outlet for discharging a first portion of the received fluid flow to the second flow passage, and a second outlet for discharging a second portion of the received fluid flow to the third flow passage; and a liquid fluid flow redistribution device disposed in the first pipe upstream with respect to fluid flow of the flow splitting tee;

wherein said liquid fluid flow redistribution device comprises a venturi scoop device disposed coaxially within the first pipe, said venturi scoop device having a body defining a central passage therethrough having a throat section and disposed coaxially within the first pipe in spaced relationship with an inner wall of the first pipe so as to form a cavity between the inner wall and said body, the body having a plurality of fluid flow openings passing therethrough to establish fluid flow communication between said cavity and said central passage.

3. A fire suppression system for extinguishing a fire in a protected space, comprising:

a plurality of fluid discharge devices disposed in operative association with the protected space;

a flow distribution network for directing a two-phase flow of an inert gaseous fluid and liquid fire extinguishing agent to said plurality of fluid discharge devices, the flow distribution network including a first pipe receiving the flow of the inert gaseous fluid and liquid fire extinguishing agent and defining a first flow passage interconnected at a flow splitting tee in fluid communication with a second pipe defining a second flow passage and a third flow passage, the flow splitting tee having an inlet for receiving fluid flow from the first flow passage, a first outlet for discharging a first portion of the received fluid flow to the second flow passage, and a second outlet for discharging a second portion of the received fluid flow to the third flow passage; and a liquid fluid flow redistribution device disposed in the first pipe upstream with respect to fluid flow of the flow splitting tee;

wherein said liquid fluid flow redistribution device comprises a venturi scoop device disposed coaxially within the first pipe, said venturi scoop device having a body defining a central passage therethrough having a throat section and disposed coaxially within the first pipe in spaced relationship with an inner wall of the first pipe so as to form a cavity between the inner wall and said body, the body having a plurality of fluid flow openings passing therethrough to establish fluid flow communication between said cavity and said central passage;

wherein said venturi scoop device disposed coaxially within the first pipe, the body of said venturi scoop device comprises a longitudinally elongated shell having a throat, a converging section extending axially in an upstream direction from the throat and a divergent section extending axially in a downstream direction from the throat.

4. A fire suppression system for extinguishing a fire in a protected space, comprising:

a plurality of fluid discharge devices disposed in operative association with the protected space;

a flow distribution network for directing a two-phase flow of an inert gaseous fluid and liquid fire extinguishing agent to said plurality of fluid discharge devices, the flow distribution network including a first pipe receiving the flow of the inert gaseous fluid and liquid fire extinguishing agent and defining a first flow passage interconnected at a flow splitting tee in fluid communication with a second pipe defining a second flow passage and a third flow passage, the flow splitting tee having an inlet for receiving fluid flow from the first flow passage, a first outlet for discharging a first portion of the received fluid flow to the second flow passage, and a second outlet for discharging a second portion of the received fluid flow to the third flow passage; and a liquid fluid flow redistribution device disposed in the first pipe upstream with respect to fluid flow of the flow splitting tee, wherein said liquid fluid flow redistribution device comprises a first perforated plate disposed transversely across the first flow passage upstream with respect to fluid flow of the inlet to the flow splitting tee;

a second perforated plate disposed transversely across the second flow passage downstream with respect to fluid flow of the first outlet of the flow splitting tee; and a third perforated plate disposed transversely across the third flow passage downstream with respect to fluid flow of the second outlet of the flow splitting tee; and a first flow turbulence generating device disposed in the second flow passage downstream with respect to fluid flow of the first outlet of the flow splitting tee and a second flow turbulence generating device disposed in the third flow passage downstream with respect to fluid flow of the second outlet of the flow splitting tee;

wherein said first and second flow turbulence generating devices each comprise a vortex generating device.

5. A fire suppression system for extinguishing a fire in a protected space, comprising:

a plurality of fluid discharge devices disposed in operative association with the protected space;

a flow distribution network for directing a two-phase flow of an inert gaseous fluid and liquid fire extinguishing agent to said plurality of fluid discharge devices, the flow distribution network including a first pipe receiving the flow of the inert gaseous fluid and liquid fire extinguishing agent and defining a first flow passage interconnected at a flow splitting tee in fluid communication with a second pipe defining a second flow passage and a third flow passage, the flow splitting tee having an inlet for receiving fluid flow from the first flow passage, a first outlet for discharging a first portion of the received fluid flow to the second flow passage, and a second outlet for discharging a second portion of the received fluid flow to the third flow passage;

a liquid fluid flow redistribution device disposed in the first pipe upstream with respect to fluid flow of the flow splitting tee, wherein said liquid fluid flow redistribution device comprises a first perforated plate disposed transversely across the first flow passage upstream with respect to fluid flow of the inlet to the flow splitting tee; and an inner tubular liner having an interior passage disposed coaxially within the first pipe and defining an axially extending annular space between the tubular liner and an inner wall of the first pipe, said annular space defining an annular flow passage and the interior passage of the tubular liner defining the first flow passage, said tubular liner having a plurality of openings therein establishing fluid flow communication between the annular flow passage and the first flow passage.

6. A fire suppression system as recited in claim 5 wherein the annular flow passage comprises a flow passage for conveying inert gas only and the first flow passage comprises a flow passage for conveying a two-phase mixture of liquid fire extinguishing agent and inert gas.

* * * * *